US008469184B2

(12) United States Patent
Spivey, Sr.

(10) Patent No.: US 8,469,184 B2
(45) Date of Patent: Jun. 25, 2013

(54) PACKAGE WITH HANDLE

(75) Inventor: Raymond R. Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 110 days.

(21) Appl. No.: 12/417,860

(22) Filed: Apr. 3, 2009

(65) Prior Publication Data

US 2009/0250357 A1 Oct. 8, 2009

Related U.S. Application Data

(60) Provisional application No. 61/043,241, filed on Apr. 8, 2008.

(51) Int. Cl.
*B65D 75/00* (2006.01)

(52) U.S. Cl.
USPC ..... 206/162; 206/141; 206/200

(58) Field of Classification Search
USPC ..... 206/145, 147, 148, 162, 200, 428
See application file for complete search history.

(56) References Cited

U.S. PATENT DOCUMENTS

| | | | | |
|---|---|---|---|---|
| 2,111,621 | A * | 3/1938 | Gerking et al. | 206/198 |
| 2,575,654 | A * | 11/1951 | Casler | 206/183 |
| 3,942,631 | A | 3/1976 | Sutherland et al. | |
| 4,386,699 | A | 6/1983 | Sutherland | |
| 4,681,217 | A | 7/1987 | Hernandez | |
| 4,941,624 | A * | 7/1990 | Schuster | 229/117.13 |
| 5,139,147 | A | 8/1992 | Sutherland | |
| 5,167,325 | A * | 12/1992 | Sykora | 206/143 |
| 5,297,673 | A | 3/1994 | Sutherland | |
| 5,310,050 | A | 5/1994 | Sutherland | |
| 5,310,051 | A | 5/1994 | Sutherland | |
| 5,323,895 | A | 6/1994 | Sutherland et al. | |
| 5,328,024 | A | 7/1994 | Sutherland | |
| 5,351,815 | A | 10/1994 | Fogle et al. | |

(Continued)

FOREIGN PATENT DOCUMENTS

| | | |
|---|---|---|
| JP | 8-507486 | 8/1996 |
| JP | 2003-146359 | 5/2003 |

(Continued)

OTHER PUBLICATIONS

PCT/US2008/080279—International Search Report and Written Opinion.

(Continued)

*Primary Examiner* — J. Gregory Pickett
*Assistant Examiner* — Kaushikkumar Desai
(74) *Attorney, Agent, or Firm* — Womble Carlyle Sandridge & Rice, LLP

(57) ABSTRACT

A package is for holding a plurality of articles. The package has panels that extend at least partially around an interior of the package. The panels comprise a top panel and at least one side panel foldably connected to the top panel. At least one opening is in the top panel for at least partially receiving at least a portion of one of the articles. A handle opening is in the top panel. A handle comprises a first handle portion and a second handle portion. At least the first handle portion is positioned relative to the handle opening for use in grasping and carrying the package, and at least the second handle portion is at least partially in contact with an interior surface of the top panel.

16 Claims, 15 Drawing Sheets

U.S. PATENT DOCUMENTS

| | | | | | |
|---|---|---|---|---|---|
| 5,351,816 | A | | 10/1994 | Sutherland et al. | |
| 5,351,817 | A | | 10/1994 | Sutherland | |
| 5,355,999 | A | | 10/1994 | Sutherland | |
| 5,360,104 | A | | 11/1994 | Sutherland | |
| 5,363,954 | A | | 11/1994 | Dampier | |
| 5,390,784 | A | | 2/1995 | Sutherland | |
| 5,407,065 | A | | 4/1995 | Sutherland | |
| 5,415,278 | A | | 5/1995 | Sutherland | |
| 5,443,153 | A | | 8/1995 | Sutherland | |
| 5,445,262 | A | | 8/1995 | Sutherland | |
| 5,452,799 | A | | 9/1995 | Sutherland | |
| 5,474,172 | A | * | 12/1995 | Zavatone et al. | 206/158 |
| 5,501,335 | A | * | 3/1996 | Harris | 206/427 |
| 5,503,267 | A | | 4/1996 | Sutherland | |
| 5,520,283 | A | | 5/1996 | Sutherland | |
| 5,524,756 | A | | 6/1996 | Sutherland | |
| 5,551,566 | A | | 9/1996 | Sutherland | |
| 5,582,289 | A | * | 12/1996 | Wright | 206/139 |
| 5,593,027 | A | | 1/1997 | Sutherland | |
| 5,639,017 | A | | 6/1997 | Fogle | |
| 5,735,394 | A | * | 4/1998 | Harrelson | 206/151 |
| 5,746,310 | A | | 5/1998 | Slomski | |
| 5,794,778 | A | | 8/1998 | Harris | |
| 5,816,391 | A | | 10/1998 | Harris | |
| 5,871,090 | A | * | 2/1999 | Doucette et al. | 206/170 |
| 5,873,515 | A | | 2/1999 | Dunn | |
| 5,915,546 | A | | 6/1999 | Harrelson | |
| 5,960,945 | A | | 10/1999 | Sutherland | |
| 5,979,747 | A | * | 11/1999 | Gnadt et al. | 229/120.17 |
| 5,992,733 | A | | 11/1999 | Gomes | |
| 6,065,590 | A | | 5/2000 | Spivey | |
| 6,315,111 | B1 | | 11/2001 | Sutherland | |
| 6,484,903 | B2 | | 11/2002 | Spivey et al. | |
| 6,896,130 | B2 | | 5/2005 | Theelen | |
| 6,926,193 | B2 | | 8/2005 | Smalley | |
| 7,011,209 | B2 | * | 3/2006 | Sutherland et al. | 206/175 |
| 2002/0195371 | A1 | | 12/2002 | Brown | |
| 2003/0080004 | A1 | | 5/2003 | Olsen et al. | |
| 2003/0111362 | A1 | * | 6/2003 | Sutherland et al. | 206/162 |
| 2003/0213705 | A1 | | 11/2003 | Woog | |
| 2007/0029371 | A1 | | 2/2007 | Theelen | |
| 2007/0164091 | A1 | | 7/2007 | Fogle et al. | |
| 2007/0181658 | A1 | | 8/2007 | Sutherland | |

FOREIGN PATENT DOCUMENTS

| | | |
|---|---|---|
| JP | 2003-300554 | 10/2003 |
| JP | 38-17186 | 8/2006 |
| WO | WO 95/02546 | 1/1995 |

OTHER PUBLICATIONS

PCT/US2009/039395—International Search Report and Written Opinion.

Notification of Reason for Refusal and English translation for JP Application No. 2011-504088, dated Sep. 13, 2012.

Supplementary European Search Report for EP 09 73 0020 dated Apr. 19, 2012.

* cited by examiner

PACKAGE WITH HANDLE

CROSS-REFERENCE TO RELATED APPLICATION

This application claims the benefit of U.S. Provisional Application No. 61/043,241, which was filed on Apr. 8, 2008. The entire contents of the above-referenced provisional application is hereby incorporated by reference for all purposes as if presented herein in their entirety.

BACKGROUND OF THE DISCLOSURE

The present disclosure generally relates to packages or cartons for holding and carrying containers.

SUMMARY OF THE DISCLOSURE

In general, one aspect of the disclosure is generally directed to a package for holding a plurality of articles. The package has panels that extend at least partially around an interior of the package. The panels comprise a top panel and at least one side panel foldably connected to the top panel. At least one opening is in the top panel for at least partially receiving at least a portion of one of the articles. A handle opening is in the top panel. A handle comprises a first handle portion and a second handle portion. At least the first handle portion is positioned relative to the handle opening for use in grasping and carrying the package, and at least the second handle portion is at least partially in contact with an interior surface of the top panel.

In another aspect, the disclosure is generally directed to blanks for forming a package for holding a plurality of articles. The blanks comprise a first blank and a second blank. The first blank is for forming the package and comprises a top panel and at least one side panel foldably connected to the top panel, at least one opening in the top panel for at least partially receiving at least a portion of one of the articles, and a handle opening in the top panel. The second blank is for forming the handle, and comprises a first handle portion for being positioned relative to the handle opening for use in grasping and carrying the package and a second handle portion for being at least partially in contact with an interior surface of the top panel. The first handle portion comprises at least one handle panel having an handle aperture and the second handle portion comprises at least one lower handle panel foldably connected to the at least one handle panel.

In another aspect, the disclosure is generally directed to a package blank for forming a package for containing a plurality of articles. The package blank comprises a top panel, at least one side panel foldably connected to the top panel, and at least one opening in the top panel for at least partially receiving at least a portion of one of the articles. The package blank further comprises an elongate handle opening for cooperating with a handle that is positioned relative to the handle opening for use in grasping and carrying the package formed from the blank. The handle extending upwardly from the top panel through the handle opening.

In another aspect, the disclosure is generally directed to a handle blank for forming a handle positional relative to a handle opening in a top panel of a package for holding a plurality of articles. The handle blank comprises a first handle portion and a second handle portion. The first handle portion comprises at least one handle panel having a handle aperture. The at least one handle panel is for being positioned relative to the handle opening for use in grasping and carrying the package. The second handle portion is for being at least partially in contact with an interior surface of the top panel. The second handle panel comprises at least one lower handle panel foldably connected to the at least one handle panel.

In another aspect, the disclosure is generally directed to a method of forming a package for holding a plurality of articles. The method comprises acquiring a package blank. The package blank comprises a top panel, at least one side panel foldably connected to the top panel, at least one opening in the top panel for at least partially receiving at least a portion of one of the articles, and an elongate handle opening in the top panel. The method further comprises positioning a plurality of articles relative to the blank, positioning a handle relative to the blank, the handle comprises a first handle portion and a second handle portion. The positioning the handle comprises positioning the first handle portion relative to the handle opening for use in grasping and carrying the package, and positioning the second handle portion to be at least partially in contact with an interior surface of the top panel.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to constructs, sleeves, cartons, or the like, and packages for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Packages according to the present disclosure can accommodate containers of numerous different shapes. For the purpose of illustration and not for the purpose of limiting the scope of the disclosure, the following detailed description describes beverage containers (e.g., plastic containers) at least partially disposed within the package embodiments. In this specification, the terms "lower," "bottom," "upper" and "top" indicate orientations determined in relation to fully erected packages.

The present embodiments are addressed to cartons or packages for attachment to and accommodation of containers. A package or carrier 150 of a first embodiment is illustrated in its erected state in FIG. 5, in which it is attached to containers C arranged in two rows of three containers. In the illustrated embodiments the containers C are illustrated as beverage containers having a top portion T generally comprising a flange portion F, an upper neck portion N, and a cap CP, but containers of other sizes, shapes, and configurations, may be held in the package 150 without departing from the disclosure. The upper neck portions N of the containers C are received in respective openings 65 in the package 150 and retained in the package by retaining features described further herein. The containers C could be arranged in other than a 2×3 arrangement (e.g., 2×4, 1×3, 1×4, etc.) without departing from the disclosure. Other container types, sizes, and/or shapes, as well as other articles, may also be accommodated in cartons constructed according to the present disclosure.

In one embodiment, the package 150 includes a handle 7 (FIG. 5) for grasping and carrying the package. The handle 7 includes various features including reinforcement features as further described herein.

Figure 1:
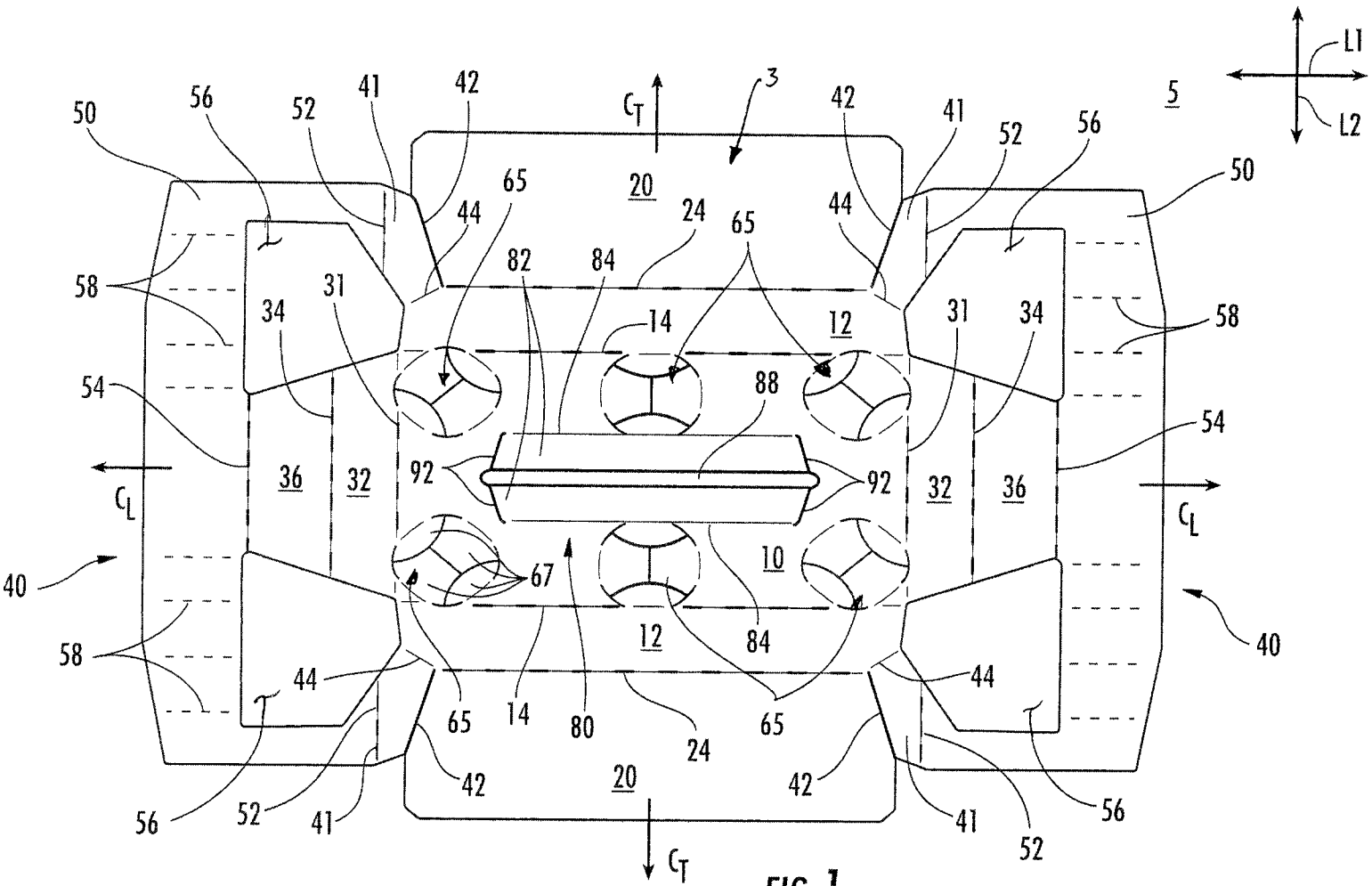
FIG. 1 is a plan view of a package blank used to form a package according to a first embodiment of the disclosure.

FIG. 1 is a plan view of an exterior surface 3 of a package blank 5 used to form the package 150 (illustrated in FIG. 5) according to the first embodiment of the disclosure. The package blank has a longitudinal axis L1 and a lateral axis L2. The package blank 5 is combined with a handle blank 105 (illustrated in FIG. 2) to form the package or carrier 150. The package 150 has retaining features for attachment to containers C. As shown in FIG. 1, the package blank 5 may have at least partial symmetry about a longitudinal center line $C_L$ and about a transverse center line $C_T$. Therefore, certain elements in the drawing figures have similar or identical reference numerals in order to reflect the whole and/or partial longitudinal and transverse symmetries of the blank 5.

Referring to FIG. 1, the package blank 5 comprises a generally rectangular top panel 10 foldably connected at each side to upper side panels 12 at longitudinal fold lines 14, and a lower side panel 20 connected to each upper side panel 12 at a longitudinal fold line 24. An upper end panel 32 is foldably connected to each end of the top panel 10 at a transverse fold line 31, and a medial end panel 36 is foldably connected to each upper end panel 32 at a transverse fold line 34.

An end web 40 is located at each end of the package blank 5. Each end web 40 comprises a connector panel 41 separated from an adjacent lower side panel 20 by an oblique cut 42 and foldably connected to an adjacent upper side panel 12 at an oblique fold line 44. Each end web 40 further comprises a wraparound lower panel 50 that is foldably connected at each of its ends to one of the connector panels 41 at a lateral fold line 52. A pair of apertures 56 is struck from each end of the blank 5, one disposed on each side of the end panels 32, 36. Each end web 40 is also connected to an adjacent medial end panel 36 at a lateral fold line 54. A plurality of longitudinal scores 58 may extend through each wraparound lower panel 50.

A handle-receiving feature 80 in the top panel 10 comprises opposed top flaps 82 foldably connected at a central portion of the top panel 10 at longitudinal fold lines 84, on either side of an elongate handle opening 88. J-cuts 92 can be formed in the top panel 10 at each end of each top flap 82 to allow the flaps to bend or pivot about the fold lines 84. A plurality of article-receiving openings 65 are formed in the top panel 10 and distributed around the handle-receiving feature 80. In one embodiment, the top panel 10 includes four retention flaps foldably connected to the top panel at each handle-receiving opening 65. The article-receiving openings 65 are formed when the retention flaps 67 are upwardly folded to engage the neck portion N of a respective container C inserted into a respective article-receiving opening. In one embodiment, the retention flaps 67 can be generally similar to the retention flaps 22, 24 forming the receptacles 12 shown in co-assigned U.S. patent application Ser. No. 12/271,253, filed Nov. 14, 2008, the entire content of which is incorporated by reference herein for all purposes. The retention flaps 67 can be otherwise shaped, arranged, configured, and/or omitted without departing from the scope of the disclosure.

In the illustrated embodiment, the fold lines 44 may be, for example, crease lines, and the fold lines 14, 24, 31, 34, 52, 84 may be, for example, cut-crease lines. The lines of disruption 58 may be cut-space lines or a series of spaced score lines. The cuts 42 may be, for example, breachable lines of disruption comprising a continuous 100% cut, a cut interrupted by nicks, or a breachable score line.

Figure 2:
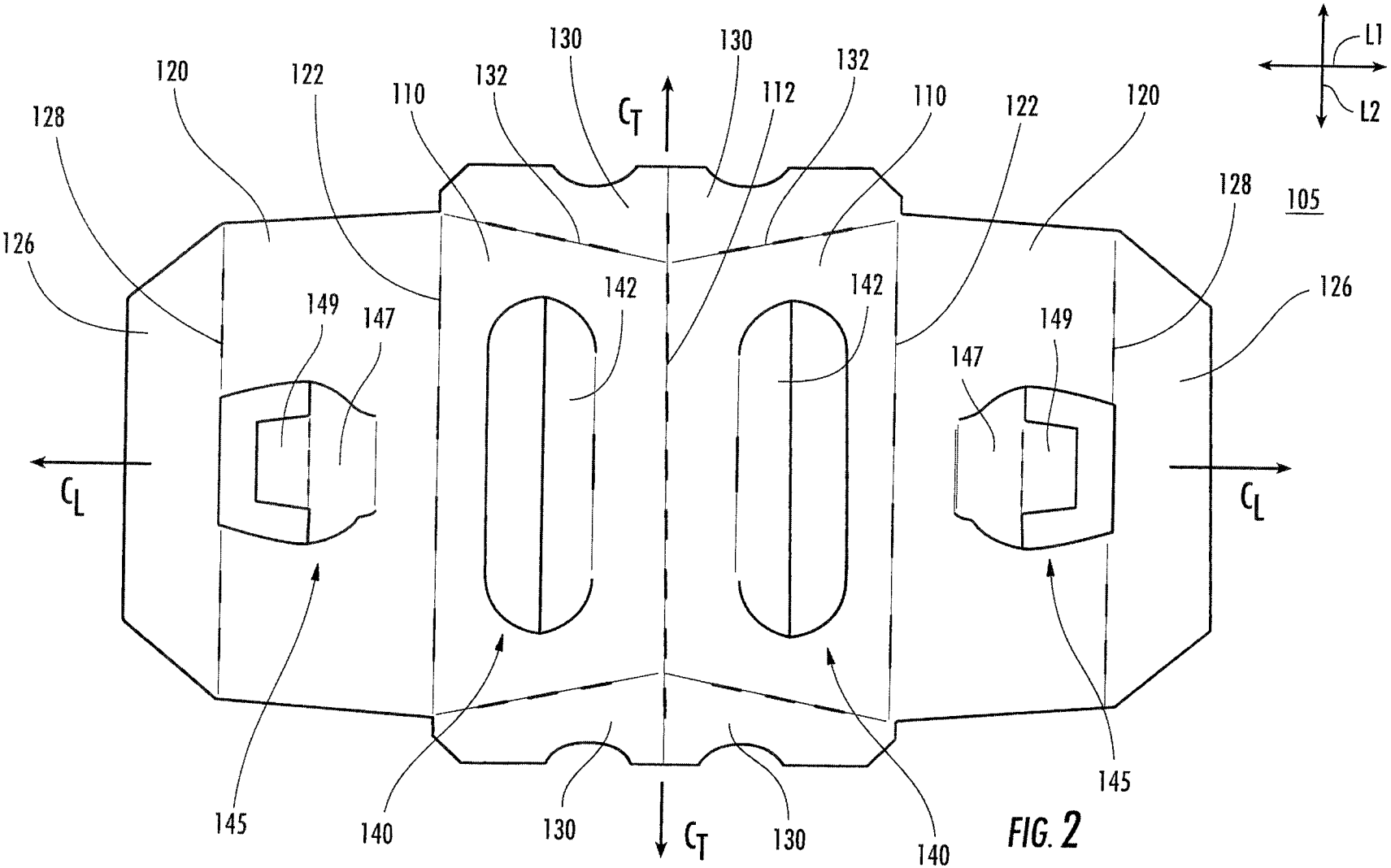
FIG. 2 is a plan view of a handle blank that is used to form the package of the first embodiment.
Figure 5:
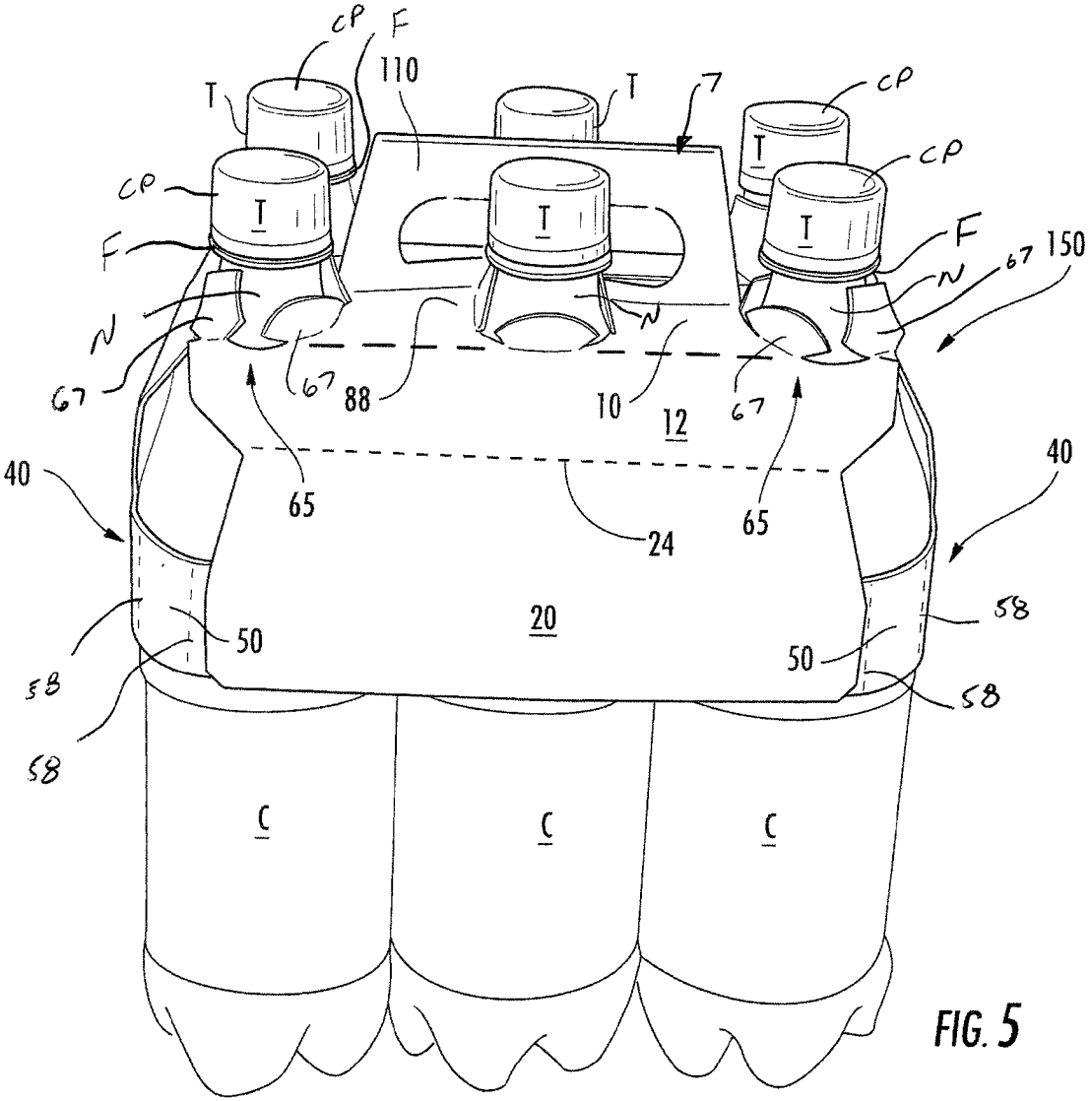
FIG. 5 is an end perspective of the assembled package of the first embodiment.
Figure 6:
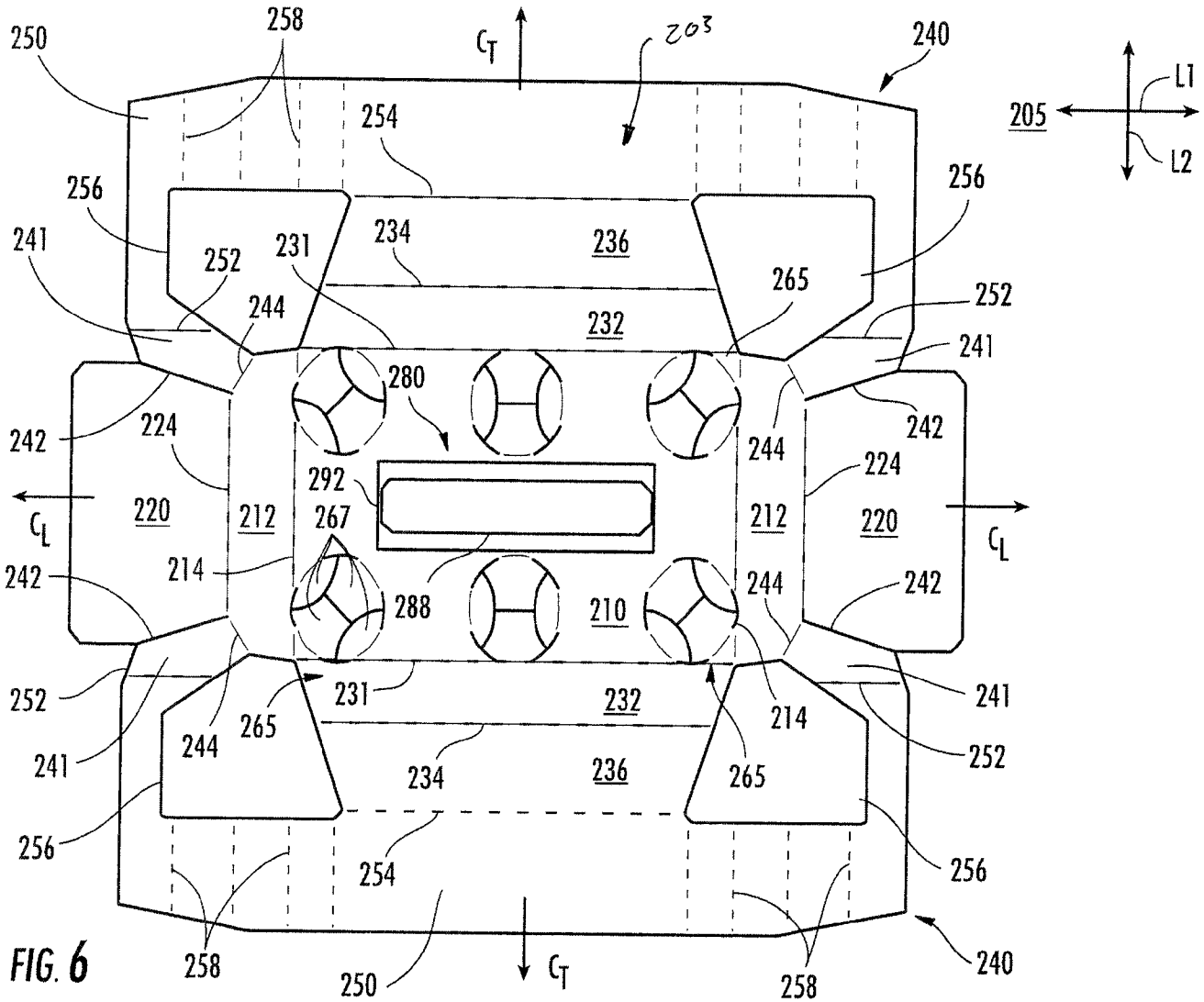
FIG. 6 is a plan view of an exterior surface of a package blank used to form a package according to a second embodiment of the disclosure.

FIG. 2 shows the handle blank 105 that is used with the package blank 5 to form the package 150 (FIGS. 5 and 6). The handle blank 105 is formed into the handle 7 of the package 150. The handle blank 105 comprises a pair of handle panels 110 that are foldably connected at a transverse fold line 112, a lower handle panel 120 foldably connected to each handle panel 110 at a transverse fold line 122, and an end flap 126 foldably connected to each lower handle panel 120 at, or along, an interrupted transverse fold line 128. A tuck-in panel 130 can be connected to each end of each handle panel 110 at an oblique fold line 132. The tuck-in panels 130 at each end of the handle blank 105 may be foldably connected to one another at the fold line 112. A handle aperture 140 is formed in each upper handle panel 110. An article-receiving aperture 145 is formed in each lower handle panel 120. In the illustrated embodiment, each of the article-receiving apertures 145 can be coextensive with an edge of the respective end flaps 126 so that the respective edge is generally collinear with the respective interrupted transverse fold line 128. Accordingly, for each of the end flaps 126, each portion of the interrupted transverse fold line 128 extends from a respective end of the end flap edge that is coextensive with the respective article-receiving aperture 145. As shown in FIG. 2, the edges of the end flaps 126 that are coextensive with the article-receiving apertures 145 are straight and are parallel to the interrupted transverse fold lines 128. In the illustrated embodiment, the fold lines 112, 122, 128, 132 may be, for example, cut-crease lines.

As shown in FIG. 2, each of the tuck-in panels 130 includes a first free edge extending from an end of the respective transverse fold line 122 and a second free edge extending from the first free edge. In the illustrated embodiment, the second free edge is oblique with respect to the first free edge. In the handle blank 105, prior to folding the tuck-in panels 130 inwardly, the first free edge is collinear with and parallel to the respective transverse fold line 122 so that the first free edge of each of the tuck-in panels extends outwardly from a free edge of the respective lower handle panel 120. Each of the tuck-in panels also includes a generally longitudinal free edge with a concave handle notch that is spaced apart from the first and second free edges. The handle notches can be disposed proximate a respective one of the handle apertures 140 when the tuck-in panels 130 are inwardly folded against the upper handle panels 110 (FIG. 3).

An exemplary method of erecting the package 150 from the blanks 5 and 105 and attaching the package to the containers is discussed below with reference to FIGS. 1-5.

Figure 3:
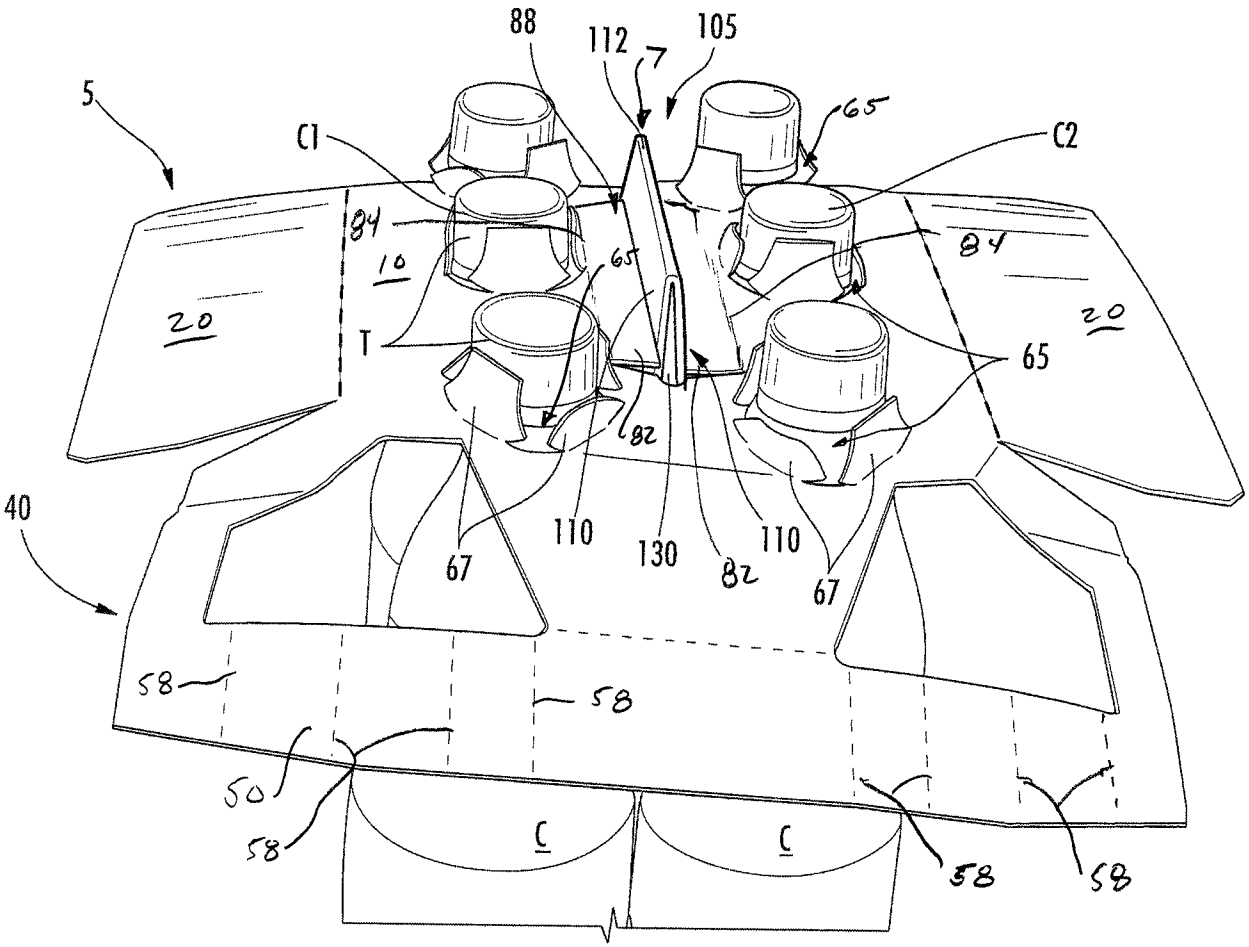
FIG. 3 is an end perspective of the package of the first embodiment being partially assembled.

Referring to FIGS. 1-3, the tuck-in panels 130 of the handle blank 105 are tucked inwardly at the oblique fold lines 132 to be in face to face contact with a respective handle panel 110. The handle blank 105 is folded about the transverse fold line 112 so that the interior sides of the opposed handle panels 110 are adjacent to and facing one another. The handle panels 110 can be spaced apart or can be placed in face-to-face contact with each other.

Figure 4:
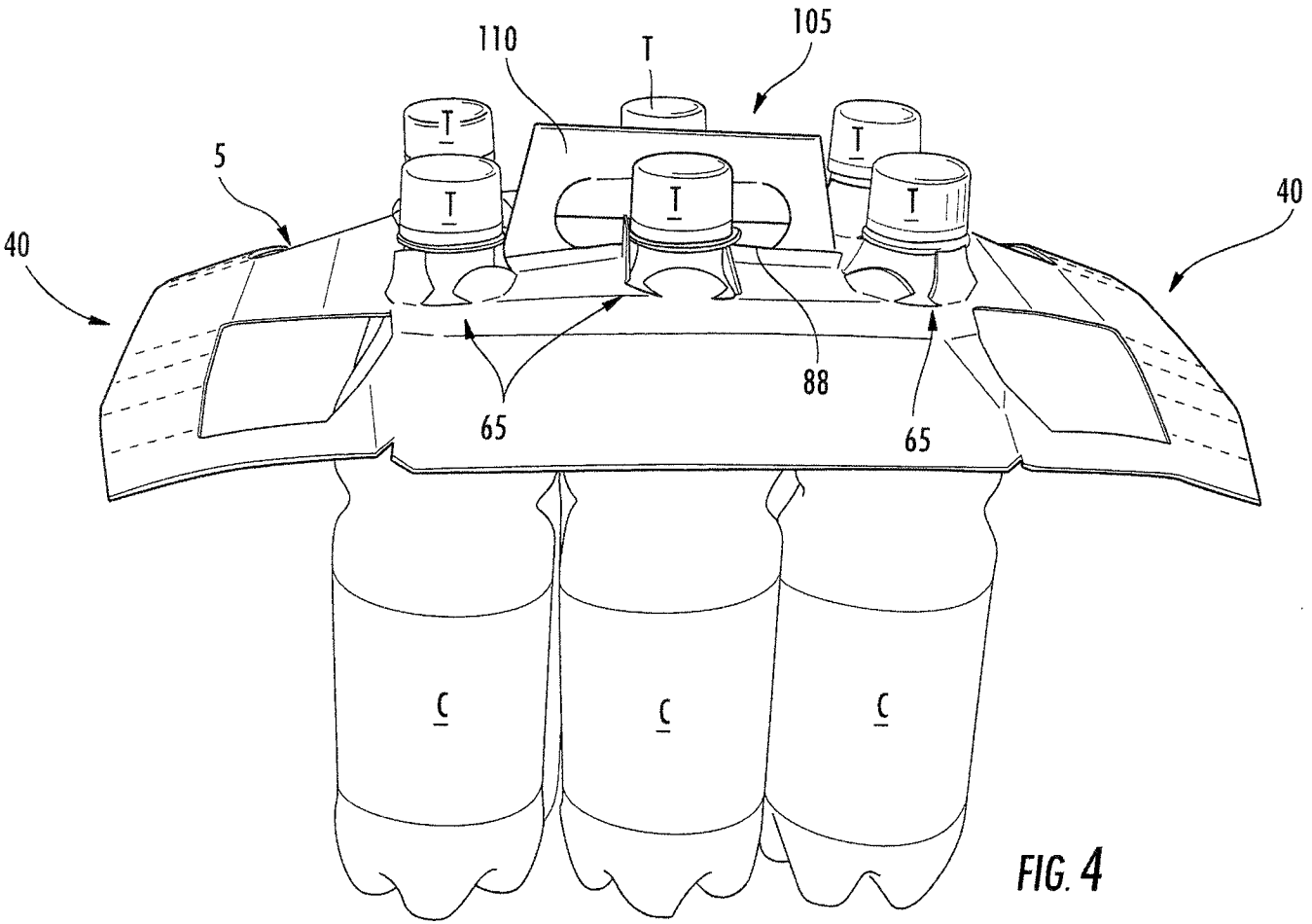
FIG. 4 is a side perspective of the package of the first embodiment being partially assembled.

Referring to FIGS. 3 and 4, a 2×3 arrangement of containers C is provided. The folded handle blank 105 is then pressed down over the tops T of the two center containers, indicated as C1 and C2 in FIG. 3, so that the center container tops T are pressed through the article receiving apertures 145 in the lower handle panels 120 of the handle blank 105. The package blank 5 is pressed down over the arrangement of containers C and over the handle blank 105. The opposed handle panels 110 of the handle blank 105 are pressed through the handle opening 88 in the package blank 5. At the same time, the tops T of the containers C are pressed through the article-receiving apertures 65 of the package blank 5. In one embodiment, the lower handle panels 120 are in face-to-face contact with the interior surface of the top panel 10 of the package blank. The handle panels 110 can be brought into face-to-face contact when the handle panels are inserted through the handle opening 88. The handle panels 110 can be adhered together or the handle panels can remain free of adhesive. Also, the lower handle panels 120 can be adhered to the top panel 10 or the lower handle panels can remain free of adhesive.

In the first embodiment, the handle 7 comprises a first handle portion (e.g., at least one of the handle panels 110) and a second handle portion (e.g., at least one of the lower handle panels 120), the first handle portion is inserted through the handle opening 88 in the top panel 10, and the second handle portion is at least partially in contact with the interior surface of the top panel.

Referring to FIGS. 3-5, the end webs 40 are folded down so that they abut and wrap around the sides of the containers C at the ends of the 2×3 arrangement. The wraparound lower panels 50 are pressed or wrapped around the sides of the end containers C, the wrapping being facilitated by the scores 58. The lower side panels 20 at each end of the package blank 5 are then folded down and adhered to the wraparound lower panels 50. In one embodiment, the wraparound panels 50 are curved to correspond with the shape of the container C at each corner of the package 150.

FIG. 5 shows the package 150 formed from the package blank 5 and the handle blank 105 secured to the containers C. As shown in FIG. 5, the package 150 can be grasped and carried at the handle 7 that extends upwardly from the top panel 10.

Figure 10:
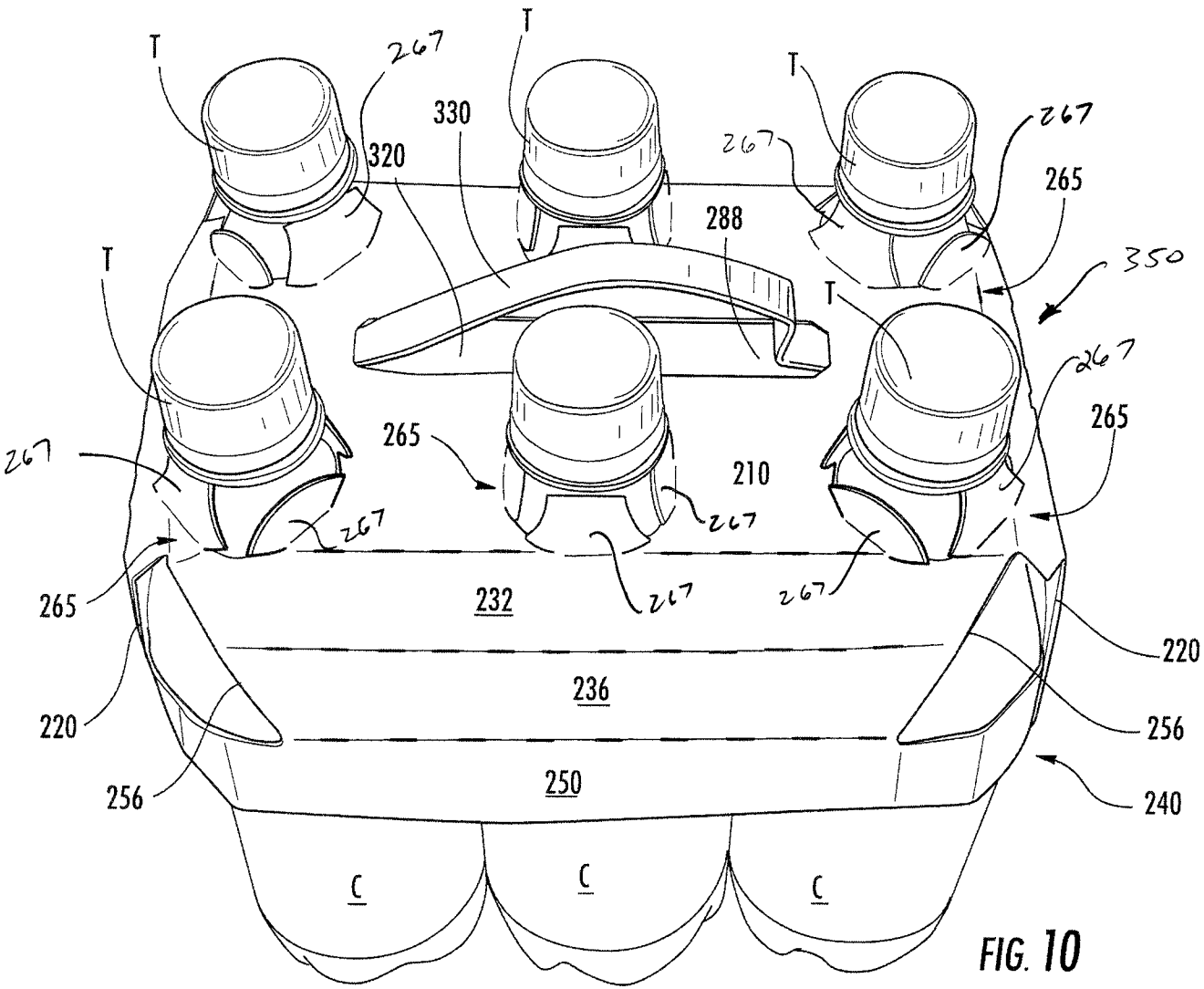
FIG. 10 is a side perspective of the package of the second embodiment.

FIG. 6 is a plan view of a exterior surface 203 of a package blank 205 used to form a package 350 (illustrated in FIG. 10) according to the second embodiment of the disclosure. The package blank 205 is combined with a handle 305 (FIG. 7) to form the package 350. The package 350 and attached containers C are illustrated in FIG. 10. As shown in FIG. 6, the package blank 205 may have at least partial symmetry about a longitudinal center line $C_L$ and about a transverse center line $C_T$. Therefore, certain elements in the drawing figures have similar or identical reference numerals in order to reflect the whole and/or partial longitudinal and transverse symmetries of the blank 205. Further, the package blank 205 of the second embodiment is generally similar to the package blank 5 of the first embodiment, and like or similar features have been given like or similar reference numbers.

Referring to FIG. 6, the package blank 205 comprises a top panel 210 foldably connected at each end to upper end panels 212 at lateral fold lines 214, and a lower end panel 220 connected to each upper end panel 212 at a lateral fold line 224. An upper side panel 232 is foldably connected to each side of the top panel 210 at a longitudinal fold line 231, and a medial side panel 236 is foldably connected to each upper side panel 232 at a longitudinal fold line 234.

A side web 240 is located at each side of the package blank 205. Each side web 240 comprises a connector panel 241 separated from an adjacent lower end panel 220 by an oblique cut 242 and foldably connected to an adjacent upper end panel 212 at an oblique fold line 244. Each side web 240 further comprises a wraparound lower panel 250 that is foldably connected at each of its ends to one of the connector panels 241 at a longitudinal fold line 252. A pair of apertures 256 is struck from each side of the blank 205, one on each end of the side panels 232, 236. Each side web 240 is also connected to an adjacent medial side panel 236 at a longitudinal fold line 254. A plurality of lateral scores 258 may extend through each side web 240.

A handle-receiving feature 280 in the top panel 210 comprises an elongate handle opening 288 struck from the center of the top panel 210. A plurality of article-receiving apertures 265 are formed in the top panel 210 and distributed around the handle-receiving feature 280. The top panel 210 includes article-retaining flaps 267 foldably connected to the top panel and adjacent the openings 265. The flaps 267 are similar to the flaps 67 of the previous embodiment and retain the containers C in a similar manner. A perimeter 292 may be defined around the handle opening 288, and may comprise a continuous or substantially continuous line of disruption such as, for example, a fold line or a crease. The perimeter 292 of the handle-receiving feature 280 allows the portion of the top panel adjacent the handle opening 288 to flex upward when the handle 305 is inserted through the handle opening.

Figure 7:
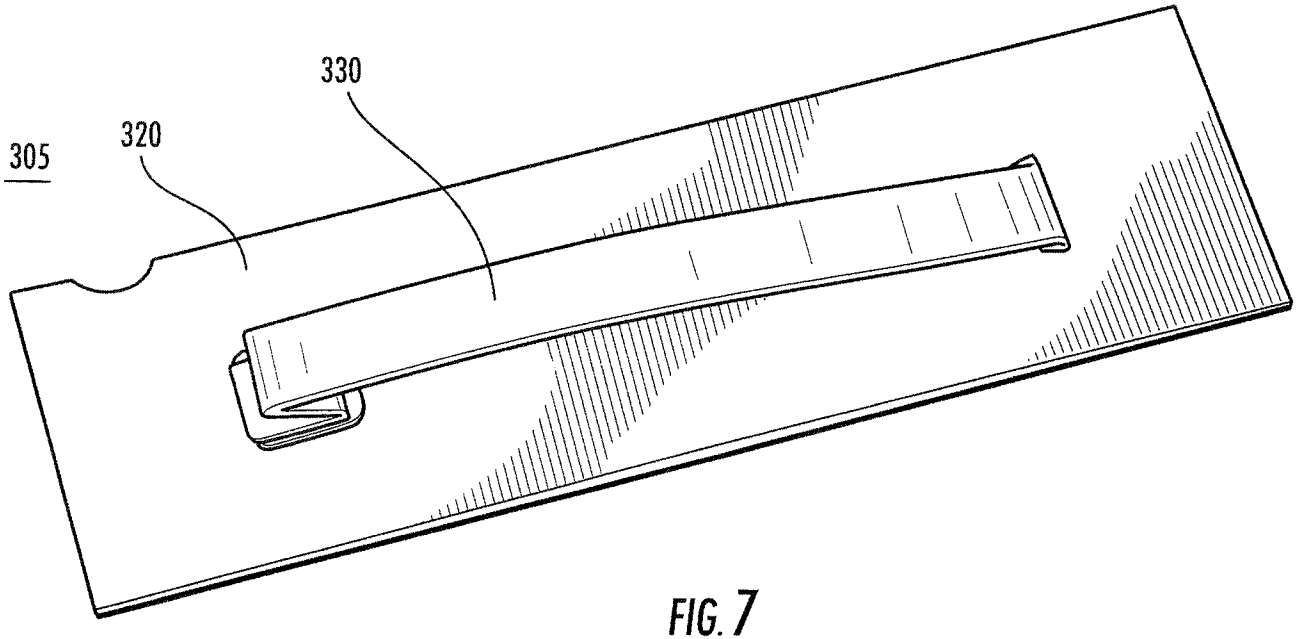
FIG. 7 is a top view of a handle used to form the package of the second embodiment.

FIG. 7 shows the handle 305 that is used with the package blank 205 to form the carton 350. In one embodiment, the handle 305 may be a prefabricated handle having a configuration commonly known as a "Wilton Handle." The handle 305 includes a base 320 and a handle strap 330 attached to the base. In the exemplary embodiment, the base 320 is 6½ inches long and is made of paperboard or other suitable material. In one embodiment, the handle strap 330 is ½ inch wide and is attached to the base 320 at each end. The handle strap 330 may be sized to pass through the handle opening 288 of the blank 205. The base 320 may be larger in plan area than the handle-receiving aperture 288.

In the second embodiment of the package 350, the handle 305 comprises a first handle portion (e.g., handle strap 320) and a second handle portion (e.g., base 320), the first handle portion is inserted through the handle opening 288 in the top panel 210, and the second handle portion is at least partially in contact with the interior surface of the top panel.

An exemplary method of erecting the package 350 from the blank 205 and the handle 305 and attaching containers C to the package 380 is discussed below with reference to FIGS. 6-10.

Figure 8:
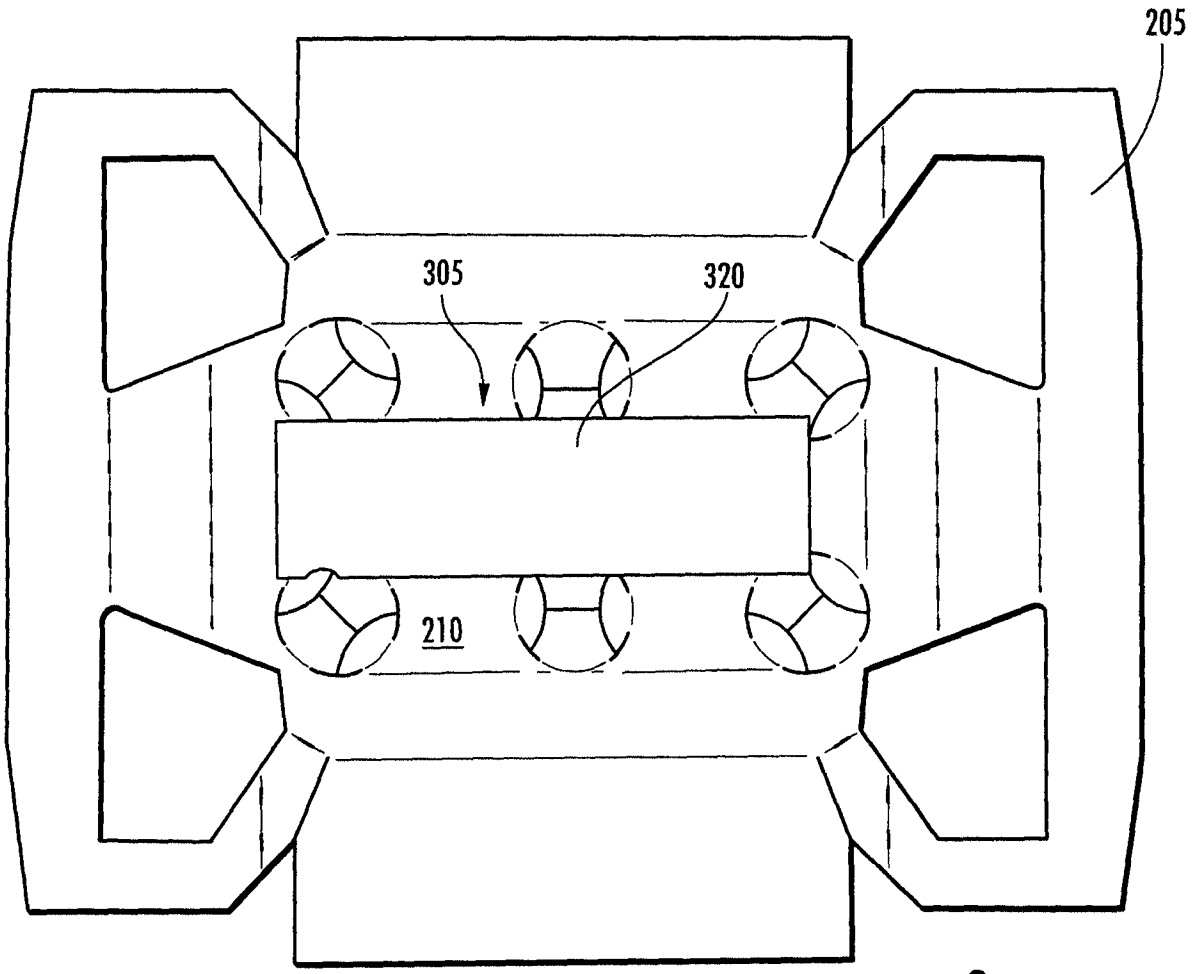
FIG. 8 is a plan view of an interior surface of the package blank of FIG. 6 and the handle of FIG. 7 partially assembled into the package of the second embodiment.
Figure 9:
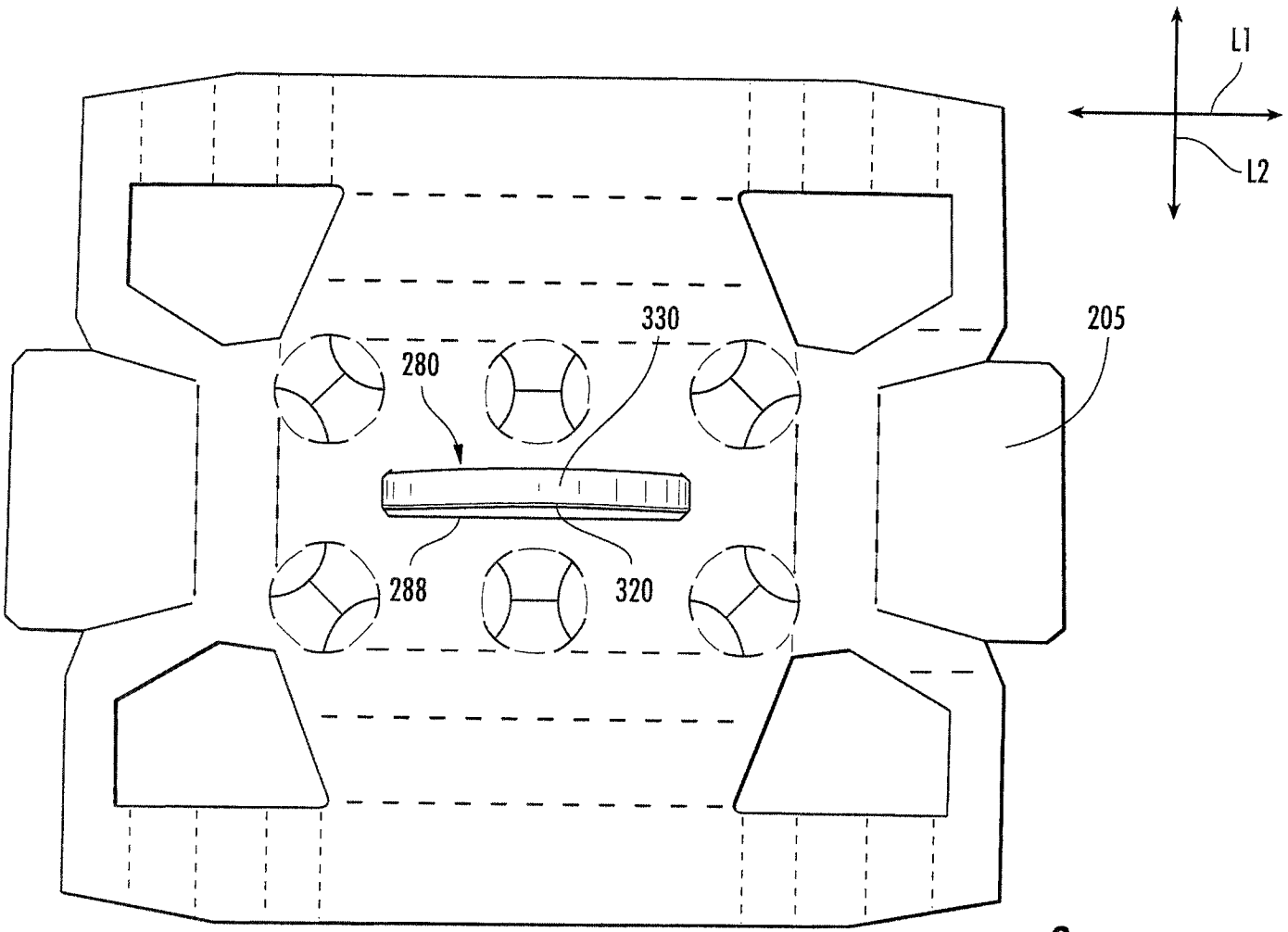
FIG. 9 is a top view of the package of the second embodiment partially assembled.

Referring to FIG. 8, the handle 305 is laid over the interior surface of the package blank 205 and is positioned in the interior surface of the top panel 210 so that the handle strap 330 rests in the handle opening 288. The base 320 of the handle 305 is in face-to-face contact with a portion of the interior surface of the top panel 210 and can be adhered to the top panel. FIG. 9 is a top view of the exterior surface 203 of the blank 205 with the handle strap 330 extending through the handle opening 288. FIG. 10 illustrates the package 350 of the second embodiment that is further formed in a similar manner as the package 150 of the previous embodiment. Also, the containers C are received in the container-receiving openings 265 in the top panel 210 and retained in the package 350 in a similar manner as the previous embodiment.

Referring to FIG. 10, a 2×3 arrangement of containers C is provided. The package blank 205 is pressed down over the arrangement of containers C. The tops T of the containers C are pressed through corresponding article-receiving apertures 265 of the package blank 205. The side webs 240 are folded down so that they abut and wrap around the sides of the containers C. In particular, the wraparound lower panels 250 are pressed around the sides of the containers C, the wrapping being facilitated by the scores 258. The lower end panels 220 are then folded down and adhered to the wraparound lower panels 250. The package 350 formed from the blank 205 and the handle 305 is thereby secured to the containers C.

The base 320 of the handle piece 302 can be sufficiently large, so that the base need not be glued to the top panel 210 of the package blank 205. For example, in one embodiment, the base 320 may be substantially as large as the top panel 210 of the package blank 205, and may include apertures in the base 320 for receiving the container tops T. To erect the package, the handle would be pressed onto the tops T of the containers C so that the tops extend through the apertures in the base of the handle. The package blank 205 would be pressed over the container tops T, as discussed above, so that the package blank 205 overlies the handle piece on the arrangement of containers C. The side webs and panels 240, 250, 220 of the package blank 205 could then be folded and glued to obtain the configuration shown in FIG. 10.

Figure 11:
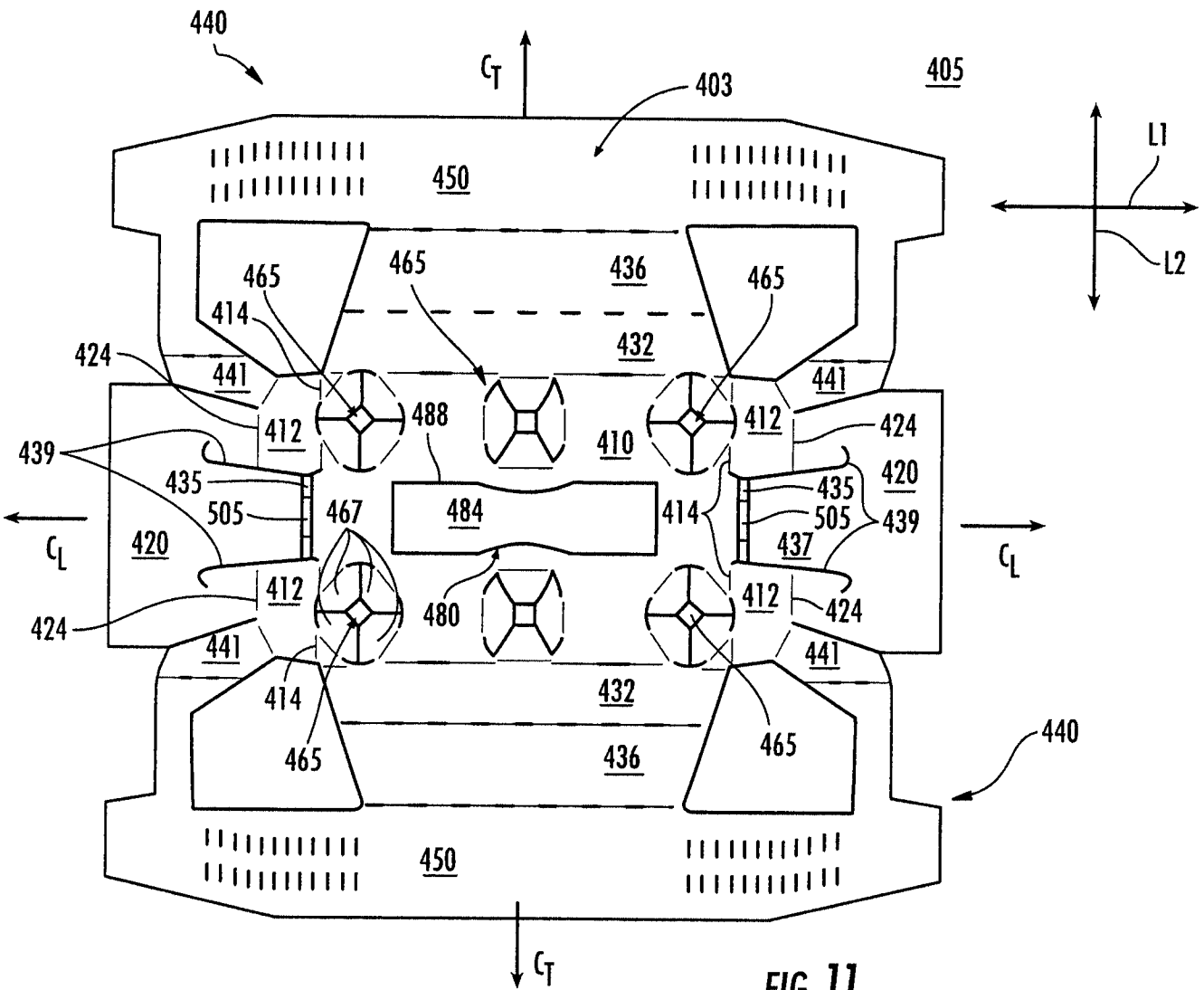
FIG. 11 is a plan view of an exterior surface of a package blank used to form a package of a third embodiment.
Figure 13:
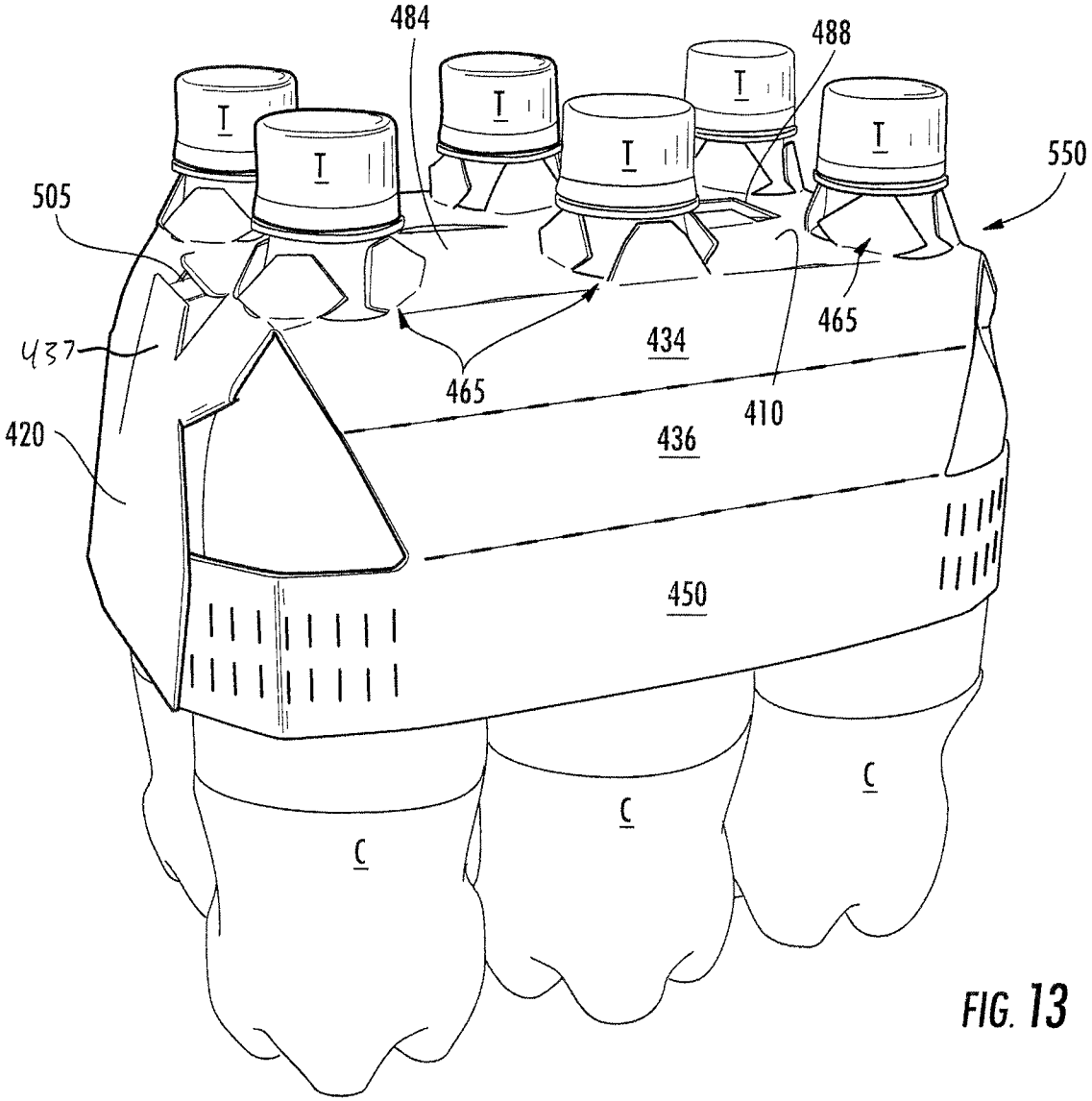
FIG. 13 is a side perspective of the package of the third embodiment.

FIG. 11 is a plan view of an exterior surface 403 of a package blank 405 used to form a package 550 (FIG. 13) according to a third embodiment of the disclosure. The package blank 550 cooperates with a handle 505 to form the package 550 with attached containers C. As shown in FIG. 11, the blank 405 may have at least partial symmetry about a longitudinal center line $C_L$ and about a transverse center line $C_T$. Therefore, certain elements in the drawing figures have similar or identical reference numerals in order to reflect the whole and/or partial longitudinal and transverse symmetries of the blank 405. Further, the package blank 405 of the third embodiment is generally similar to the package blanks 5, 205 of the first and second embodiments, and like or similar features have been given like or similar reference numbers.

Referring to FIG. 11, the blank 405 comprises a top panel 410 foldably connected to four upper end panels 412, two at each end of the top panel 410, at lateral fold lines 414, and a lower end panel 420 connected to the upper end panel 412 pair at each end of the blank at lateral fold lines 424. An upper side panel 432 is foldably connected to each side of the top panel 410 at a longitudinal fold line 431, and a medial side panel 436 is foldably connected to each upper side panel 432 at a longitudinal fold line 434. The blank 405 includes openings 435 between upper end panels 412. Each of the upper and lower end panels 412, 420 has an end handle flap 437 defined by respective J-cuts 439 extending from the openings 435 into the lower end panels 420.

A side web 440 is located at each side of the blank 405. Each side web 440 comprises a connector panel 441 separated from an adjacent lower end panel 420 by an oblique cut 442 and foldably connected to an adjacent upper end panel 412 at an oblique fold line 444. Each side web 440 further comprises a wraparound lower panel 450 that is foldably connected at each of its ends to one of the connector panels 441 at a longitudinal fold line 452. A pair of apertures 456 is struck from each side of the blank 405, one on each end of the side panels 432, 436. Each side web 440 is also connected to an adjacent medial side panel 436 at a longitudinal fold line 454. A plurality of transverse scores 458 may extend through each side web 440.

A handle feature 480 in the top panel 410 comprises an elongate handle panel 484 struck from the top panel 410 and defined by a breachable perimeter or tear line 488. When the handle panel 484 is separated or removed from the top panel 410 a handle opening 489 (FIG. 14) is in the top panel. A plurality of article-receiving apertures 465 are formed in the top panel 410 and distributed around the handle-receiving feature 480. The top panel 410 includes article-retaining flaps 467 foldably connected to the top panel and adjacent the openings 465. The flaps 467 are similar to the flaps 67, 267 of the previous embodiments and retain the containers C in a similar manner. An elongate handle reinforcement layer 505 (shown in FIG. 12) is adhered to the underside of the blank 405.

Figure 12:
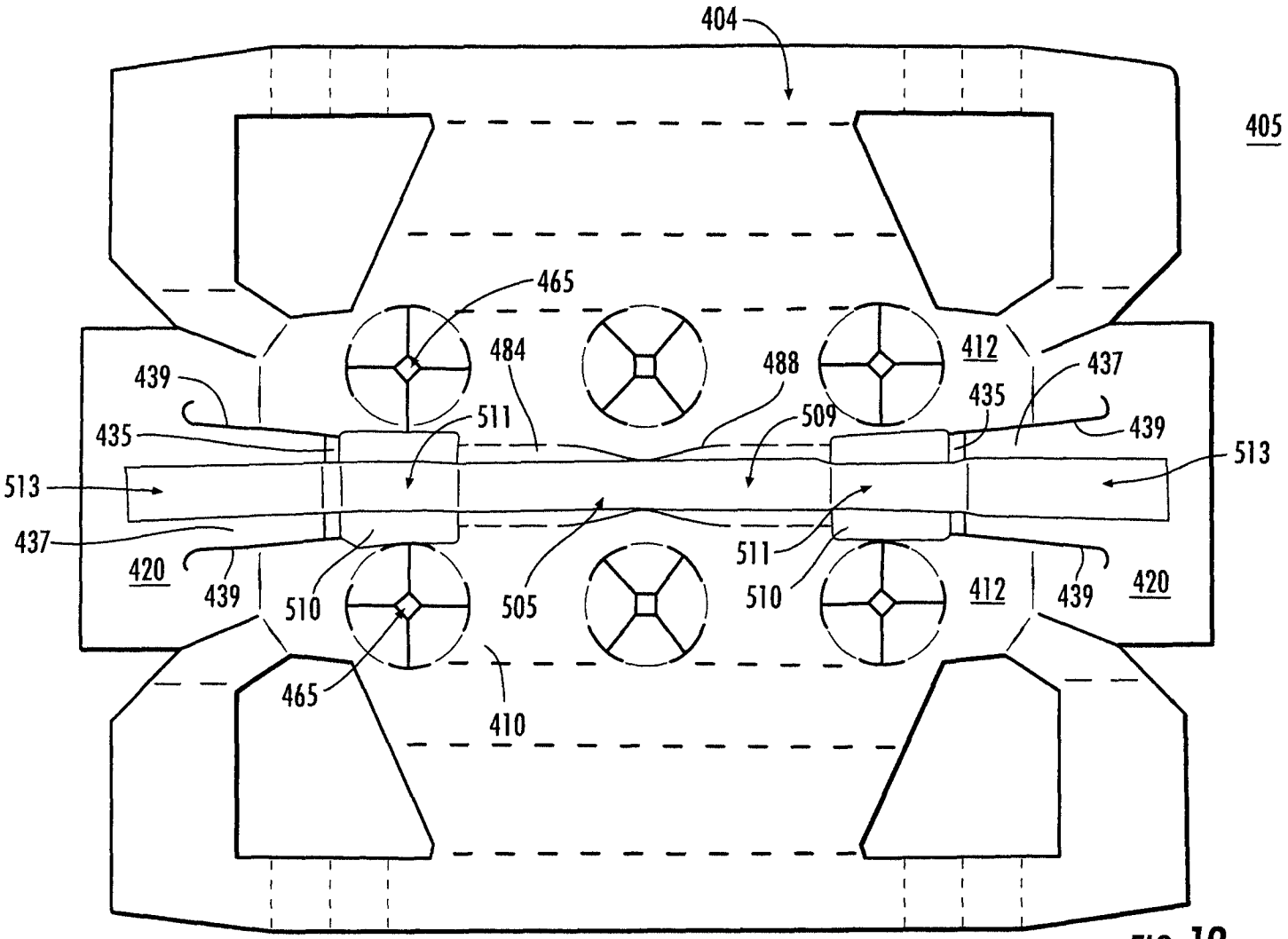
FIG. 12 is a plan view of an interior surface of the package blank of FIG. 11 and a handle partially assembled into the package of the third embodiment.

FIG. 12 shows the interior surface 404 of the blank 405 and the handle reinforcement layer 505. The handle reinforcement layer 505 may be, for example, an elongate strip of material adhered to the underside of the blank 405. The reinforcement layer 505 may be adhered to the underside of the blank 405 along substantially all of the area of the reinforcement layer 505, except at the locations 510 in the top panel 410. In the illustrated embodiment, the locations 510 are generally adjacent the ends of the handle panel 484 and the openings 435 between the top panel 410 and the end handle flaps 437. In one embodiment, the handle reinforcement layer 505 has a central portion 509 in face-to-face contact with the handle panel 484. The central portion 509 can be adhered or nonadhered to the handle panel 484. The handle reinforcement layer 505 includes non-adhered portions 511 adjacent the central portion 509 and in face-to-face contact with the locations 510 of the top panel 410. The handle reinforcement layer 504 has end portions 513 at respective ends of the reinforcement layer and adjacent the nonadhered portions 511. The non-adhered portions 511 of the reinforcement layer 505 allow the handle of the carton 550 to extend during lifting of the package 550. In the illustrated embodiment, the end portions 513 are in face-to-face contact and adhered to the end handle flaps 437 in the end panels 420, 412 of the blank 405. Alternatively, the end portions 513 can be nonadhered to the end handle flaps 437. The handle reinforcement layer 505 may be, for example, a plastic or composite filament tape, or a paper tape with filament reinforcement.

The carton 550 may be erected from the blank 405 in a manner similar to the method of erecting the carton 350 discussed above with reference to FIGS. 6-10 or the carton 150 as discussed above with reference to FIGS. 1-5.

In the third embodiment of the package 450, the handle 405 comprises a first handle portion (e.g., a central portion 509 of handle reinforcement layer 505) and a second handle portion (e.g., nonadhered portions 511), the first handle portion is inserted through the handle opening 489 in the top panel 410, and the second handle portion is at least partially in contact with the interior surface of the top panel.

Figure 15:
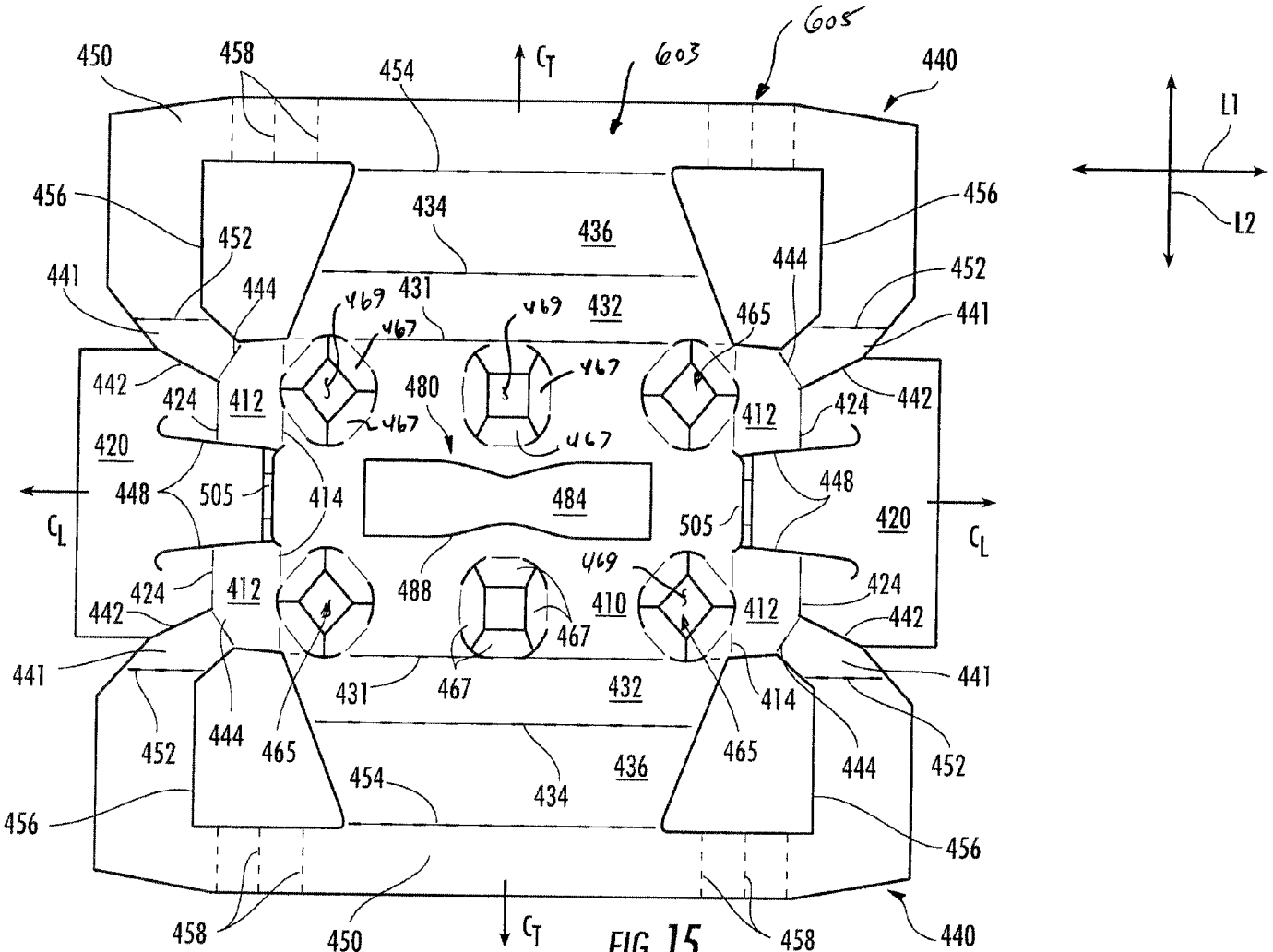
FIG. 15 is a plan view of an exterior surface of a package blank used to form a package according to a fourth embodiment.

FIG. 15 shows an exterior surface 603 of a blank 605 used to form a package (not shown) according to a fourth embodiment of the disclosure. The blank 650 is identical to the blank 405 of the previous embodiment except the flaps 467 in the top panel 410 are a different size. In the fourth embodiment, the flaps 467 are sized to provide larger openings 469 between the flaps prior to insertion of the containers C and the upwardly folding of the flaps relative to the top panel. Accordingly, like or similar features with the previous embodiments are provided with like or similar references numbers in the fourth embodiment of the blank.

Figure 14:
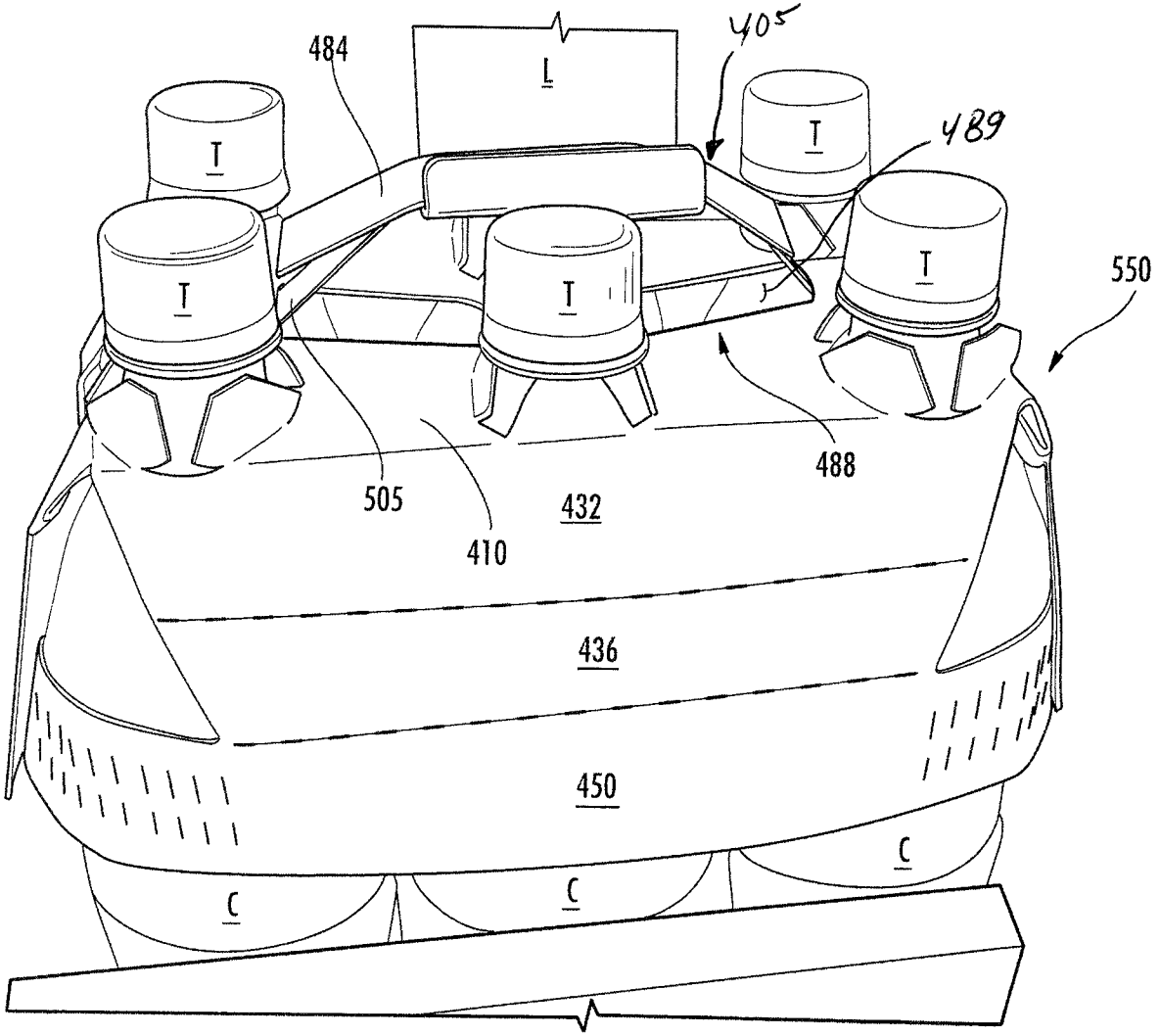
FIG. 14 is a side perspective of the package of the third embodiment with the handle positioned for carrying the package.

FIG. 14 illustrates operation of the handle 407 by a test apparatus L. The testing apparatus L lifts from the underside of the handle reinforcement layer 505 and the handle panel 484. Initial lifting breaches the tear line 488 in the top panel 410 to separate the handle panel 484 from the top panel 410 and form the opening 489 in the top panel. The central portion 509 of the handle reinforcement layer 505 can be adhered to the underside of the handle panel 484, and the end portions 513 of the handle reinforcement layer 505 can be adhered to the handle end flaps 437. Lifting loads of the package 550 are thereby borne by the handle reinforcement layer 505, which are transferred to the lower end panels 420 via the handle end flaps 437. The handle panel 484 is separated from the top panel 410 and the handle reinforcement layer 505 is allowed to extend upwardly though the opening 489 as force is exerted on the handle reinforcement layer 505.

The packages 150, 350, 550 of the illustrated embodiments could be otherwise arranged and positioned for lifting and grasping by other mechanisms. Further, the packages 150, 350, 550 could have other features (e.g., dispenser features, reinforcement features, etc.) without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding a plurality of articles, the package comprises:

panels that extend at least partially around an interior of the package, the panels comprise a top panel and at least one side panel foldably connected to the top panel;

at least one opening in the top panel for at least partially receiving at least a portion of one of the articles;

a handle opening in the top panel; and a handle comprising a first handle portion and a second handle portion, the first handle portion comprises at least a first handle panel and a second handle panel and the second handle portion comprises a first lower handle panel foldably connected to the first handle panel along a first transverse fold line, a second lower handle panel foldably connected to the second handle panel along a second transverse fold line, a first end flap foldably connected to the first lower handle panel along a third transverse fold line, and a second end flap foldably connected to the second lower handle panel along a fourth transverse fold line;

each of the first handle panel and the second handle panel comprises a handle aperture, and the first lower handle panel comprises a first article-receiving aperture for at least partially receiving an article, and the second lower handle panel comprises a second article-receiving aperture for at least partially receiving an article, the first article-receiving aperture is positioned coextensive with a first edge of the first end flap so that the first edge is generally collinear with the third transverse fold line, wherein the first edge is straight and is parallel to the third transverse fold line, and the third transverse fold line comprises two portions, each extending from a respective end of the first edge, and the second article-receiving aperture is positioned coextensive with a second edge of the second end flap so that the second edge is generally collinear with the fourth transverse fold line, wherein the second edge is straight and is parallel to the fourth transverse fold line, and the fourth transverse fold line comprises two portions, each extending from a respective end of the second edge, at least the first handle portion is positioned relative to the handle opening for use in grasping and carrying the package, and at least the second handle portion is at least partially in contact with an interior surface of the top panel, and the first handle portion comprises a pair of tuck-in panels, each of the tuck-in panels is respectively foldably connected to one of the first handle panel and the second handle panel, and the tuck-in panels are foldably connected to one another, wherein each of the tuck-in panels comprises at least a first free edge, a second free edge, and a handle notch spaced apart from the first free edge and the second free edge, the first free edge of each of the tuck-in panels extends from a respective end of a respective one of the first transverse fold line and the second transverse fold line, and the second free edge of each of the tuck-in panels extends from a respective end of the respective first free edge, the second free edge being oblique with respect to the first free edge.

2. The package of claim 1, wherein the first handle portion is inserted through the handle opening and extends upward from the top panel.

3. The package of claim 1, wherein the top panel comprises a first top flap and an opposing second top flap foldably connected to the top panel at respective longitudinal fold lines, each of the first top flap and the second top flap is adjacent to the handle opening, and each of the first top flap and the second top flap extends from adjacent a first end of the handle opening to adjacent an opposing second end of the handle opening.

4. The package of claim 1, wherein the first handle panel and the second handle panel are foldably connected and in generally face-to-face contact.

5. Blanks for forming a package for holding a plurality of articles and comprising a handle, the blanks comprise:

a first blank for forming the package, the first blank comprises a top panel and at least one side panel foldably connected to the top panel, at least one opening in the top panel for at least partially receiving at least a portion of one of the articles, and a handle opening in the top panel; and a second blank for forming the handle, the second blank comprising a first handle portion for being positioned relative to the handle opening for use in grasping and carrying the package, and a second handle portion for being at least partially in contact with an interior surface of the top panel, the first handle portion comprises at least a first handle panel and a second handle panel having a handle aperture and the second handle portion comprises a first lower handle panel foldably connected to the first handle panel along a first transverse fold line, a second lower handle panel foldably connected to the second handle panel along a second transverse fold line, a first end flap foldably connected to the first lower handle panel along a third transverse fold line, and a second end flap foldably connected to the second lower handle panel along a fourth transverse fold line, the first lower handle panel comprises a first article-receiving aperture for at least partially receiving an article, and the second lower handle panel comprises a second article-receiving aperture for at least partially receiving an article, the first article-receiving aperture is positioned coextensive with a first edge of the first end flap so that the first edge is generally collinear with the third transverse fold line, wherein the first edge is straight and is parallel to the third transverse fold line, and the third transverse fold line comprises two portions, each extending from a respective end of the first edge, and the second article-receiving aperture is positioned coextensive with a second edge of the second end flap so that the second edge is generally collinear with the fourth transverse fold line, wherein the second edge is straight and is parallel to the fourth transverse fold line, and the fourth transverse fold line comprises two portions, each extending from a respective end of the second edge, the first handle portion comprises a pair of tuck-in panels, each of the tuck-in panels is respectively foldably connected to one of the first handle panel and the second handle panel, wherein the tuck-in panels in the pair of tuck-in panels are foldably connected to one another, each of the tuck-in panels comprises at least a first free edge, a second free edge, and a handle notch spaced apart from the first free edge and the second free edge, the first free edge of each of the tuck-in panels is collinear with and parallel to a respective one of the first transverse fold line and the second transverse fold line so that the first free edge of each of the tuck-in panels extends outwardly from a respective free edge of one of the first lower handle panel or the second lower handle panel, and the second free edge of each of the tuck-in panels is oblique with respect to the respective first free edge.

6. The blanks of claim 5, wherein the first blank comprises a first top flap and an opposing second top flap foldably connected to the top panel at respective longitudinal fold lines, each of the first top flap and the second top flap is adjacent the handle opening, and each of the first top flap and the second top flap extends from adjacent a first end of the handle opening to adjacent an opposing second end of the handle opening.

7. The blanks of 5, wherein the first handle panel and the second handle panel are foldably connected.

8. The blanks of claim 5 wherein the first blank comprises at least one end panel foldably connected to the top panel and the side panel.

9. The blanks of claim 8, wherein the end panel and the side panel are foldably connected at an end web, the end web comprising a corner panel foldably connected to the side panel.

10. A handle blank for forming a handle positional relative to a handle opening in a top panel of a package for holding a plurality of articles, the handle blank comprises:

a first handle portion comprising at least a first handle panel and a second handle panel having a handle aperture, the first handle panel and the second handle panel are for being positioned relative to the handle opening for use in grasping and carrying the package;

a second handle portion for being at least partially in contact with an interior surface of the top panel, the second handle panel comprises a first lower handle panel foldably connected to the first handle panel along a first transverse fold line and a second lower handle panel foldably connected to the second handle panel along a second transverse fold line, and a first end flap foldably connected to the first lower handle panel along a third transverse fold line, and a second end flap foldably connected to the second lower handle panel along a fourth transverse fold line, the first lower handle panel comprises a first article-receiving aperture for at least partially receiving an article, and the second lower handle panel comprises a second article-receiving aperture for at least partially receiving an article, the first article-receiving aperture is positioned coextensive with a first edge of the first end flap so that the first edge is generally collinear with the third transverse fold line, wherein the first edge is straight and is parallel to the third transverse fold line, and the third transverse fold line comprises two portions, each extending from a respective end of the first edge, and the second article-receiving aperture is positioned coextensive with a second edge of the second end flap so that the second edge is generally collinear with the fourth transverse fold line, wherein the second edge is straight and is parallel to the fourth transverse fold line, and the fourth transverse fold line comprises two portions, each extending from a respective end of the second edge, and the first handle portion comprises a pair of tuck-in panels, each of the tuck-in panels is respectively foldably connected to one of the first handle panel and the second handle panel, wherein tuck-in panels are foldably connected to one another, each of the tuck-in panels comprises at least a first free edge, a second free edge, and a handle notch spaced apart from the first free edge and the second free edge, the first free edge of each of the tuck-in panels is collinear with and parallel to a respective one of the first transverse fold line and the second transverse fold line so that the first free edge of each of the tuck-in panels extends outwardly from a respective free edge of one of the first lower handle panel or the second lower handle panel, and the second free edge of each of the tuck-in panels is oblique with respect to the respective first free edge.

11. The handle blank of claim 10, wherein the first handle panel and the second handle panel are foldably connected.

12. A method of forming a package for holding a plurality of articles, the method comprises:

acquiring a package blank, the package blank comprises a top panel, at least one side panel foldably connected to the top panel, at least one opening in the top panel for at least partially receiving at least a portion of one of the articles, and an elongate handle opening in the top panel;

positioning a plurality of articles relative to the blank; and positioning a handle relative to the blank, the handle comprises a first handle portion and a second handle portion, the first handle portion comprises at least a first handle panel and a second handle panel and the second handle portion comprises a first lower handle panel foldably connected to the first handle panel along a first transverse, fold line and a second lower handle panel foldably connected to the second handle panel along a second transverse fold line, a first end flap foldably connected to the first lower handle panel along a third transverse fold line, and a second end flap foldably connected to the second lower handle panel along a fourth transverse fold line, each of the at least two handle panels comprises a handle aperture, and the first lower handle panel comprises a first article-receiving aperture for at least partially receiving an article, and the second lower handle panel comprises a second article-receiving aperture for at least partially receiving an article, the first article-receiving aperture is coextensive with a first edge of the first end flap so that the first edge is generally collinear with the third transverse fold line, wherein the first edge is straight and is parallel to the third transverse fold line, and the third transverse fold line comprises two portions, each extending from a respective end of the first edge, and the second article-receiving aperture is coextensive with a second edge of the second end flap so that the second edge is generally collinear with the fourth transverse fold line, wherein the second edge is straight and is parallel to the fourth transverse fold line, and the fourth transverse fold line comprises two portions, each extending from a respective end of the second edge, the first handle portion comprises a pair of tuck-in panels, each of the tuck-in panels is respectively foldably connected to one of the first handle panel and the second handle panel, and the tuck-in panels are foldably connected to one another, wherein each of the tuck-in panels comprises at least a first free edge, a second free edge, and a handle notch spaced apart from the first free edge and the second free edge, and, prior to forming the handle, the first free edge of each of the tuck-in panels is collinear with and parallel to a respective one of the first transverse fold line and the second transverse fold line so that the first free edge of each of the tuck-in panels extends outwardly from a respective free edge of one of the first lower handle panel or the second lower handle panel, and the second free edge of each of the tuck-in panels is oblique with respect to the respective first free edge, the positioning the handle comprises positioning the first handle portion relative to the handle opening for use in grasping and carrying the package, and positioning the second handle portion to be at least partially in contact with an interior surface of the top panel.

13. The method of claim 12, wherein the positioning the handle comprises inserting the first handle portion through the handle opening so that the first handle portion extends upwardly from the top panel.

14. The method of claim 12, wherein the positioning the handle comprises positioning the first lower handle panel so that at least one of the articles is received in the first article-receiving aperture and positioning the second lower handle panel so that at least one of the articles is received in the second article-receiving aperture.

15. The method of claim 14, wherein the positioning the handle comprises placing the first handle panel and the second handle panel in generally face-to-face contact.

16. The method of claim 15, wherein the positioning the handle comprises placing each of the tuck-in panels in face-to-face contact with a respective one of the first handle panel and the second handle panel.

* * * * *